US011479398B2

(12) United States Patent
Wilkes et al.

(10) Patent No.: US 11,479,398 B2
(45) Date of Patent: Oct. 25, 2022

(54) METHOD FOR SEALING A FITMENT TO A FLEXIBLE CONTAINER AND FLEXIBLE CONTAINER COMPRISING A FITMENT

(71) Applicant: Dow Global Technologies LLC, Midland, MI (US)

(72) Inventors: Kenneth R. Wilkes, Asheville, NC (US); John R. Kiffmeyer, Asheville, NC (US); Ryan N. French, Candler, NC (US); Miguel Avalos, Weaverville, NC (US)

(73) Assignee: Dow Global Technologies LLC, Midland, MI (US)

( * ) Notice: Subject to any disclaimer, the term of this patent is extended or adjusted under 35 U.S.C. 154(b) by 48 days.

(21) Appl. No.: 17/049,513

(22) PCT Filed: Apr. 26, 2019

(86) PCT No.: PCT/US2019/029326
§ 371 (c)(1),
(2) Date: Oct. 21, 2020

(87) PCT Pub. No.: WO2019/210151
PCT Pub. Date: Oct. 31, 2019

(65) Prior Publication Data

US 2021/0053738 A1 Feb. 25, 2021

Related U.S. Application Data

(60) Provisional application No. 62/663,157, filed on Apr. 26, 2018.

(51) Int. Cl.
*B65D 75/00* (2006.01)
*B65D 75/58* (2006.01)
*B31B 70/84* (2017.01)

(52) U.S. Cl.
CPC ..... *B65D 75/5883* (2013.01); *B65D 75/008* (2013.01); *B31B 70/844* (2017.08); *B65D 2575/583* (2013.01)

(58) Field of Classification Search
CPC ..... B65D 75/5883; B65D 75/008; B65D 2575/583; B31B 70/844
See application file for complete search history.

(56) References Cited

U.S. PATENT DOCUMENTS 3,380,646 A 4/1968 Doyen et al.
4,415,085 A 11/1983 Clarke et al.
(Continued)

FOREIGN PATENT DOCUMENTS

WO 02/055402 A2 7/2002

*Primary Examiner* — Frederick C Nicolas
(74) *Attorney, Agent, or Firm* — Quarles & Brady LLP

(57) ABSTRACT

The present disclosure provides a method for sealing a fitment to a flexible container. In an embodiment, the method includes placing a fitment into the neck of a four panel flexible container formed from flexible film. The process includes complementarily aligning a multiseal around a base of the fitment. The process includes providing a plurality of primary seals (and flaps), secondary seals, and tertiary seals onto the base with respective primary sealing jaws, secondary sealing jaws, and tertiary sealing jaws to form the multiseal, wherein the secondary seals overlap the primary seals, and the tertiary seals overlap the primary seals and the secondary seals.

2 Claims, 6 Drawing Sheets

(56) References Cited

U.S. PATENT DOCUMENTS

| | | | | |
|---|---|---|---|---|
| 4,732,299 | A | 3/1988 | Hoyt | |
| 5,606,844 | A * | 3/1997 | Takagaki | B29C 66/30223 53/DIG. 2 |
| 5,660,477 | A | 8/1997 | Ichikawa | |
| 5,851,072 | A | 12/1998 | LaFleur | |
| 6,164,822 | A * | 12/2000 | Beer | B65D 75/008 383/906 |
| 6,745,923 | B2 * | 6/2004 | Julian | B65D 5/748 222/541.6 |
| 6,832,852 | B2 | 12/2004 | Wilkes | |
| 6,860,406 | B2 * | 3/2005 | Kobetsky | B29C 66/53263 222/107 |
| 6,991,121 | B1 * | 1/2006 | Kipperman | A61J 9/005 215/11.1 |
| 7,147,597 | B2 | 12/2006 | Wilkes | |
| RE39,520 | E * | 3/2007 | Hess, III | B65D 75/5822 222/541.6 |
| 7,350,669 | B2 * | 4/2008 | Rani | A61J 1/10 604/905 |
| 8,231,029 | B2 | 7/2012 | Peer et al. | |
| 8,348,509 | B2 | 1/2013 | Wilkes et al. | |
| 8,840,305 | B2 | 9/2014 | Wilkes et al. | |
| 9,896,253 | B2 | 2/2018 | You et al. | |
| 10,035,621 | B2 * | 7/2018 | Warner | B65D 1/0215 |
| 10,427,852 | B2 | 10/2019 | Franca et al. | |
| 2003/0000963 | A1 * | 1/2003 | Julian | B65D 5/748 222/107 |
| 2013/0020328 | A1 | 1/2013 | Duan et al. | |
| 2018/0071991 | A1 | 3/2018 | Wilkes et al. | |
| 2018/0079573 | A1 | 3/2018 | Wilkes et al. | |

* cited by examiner

METHOD FOR SEALING A FITMENT TO A FLEXIBLE CONTAINER AND FLEXIBLE CONTAINER COMPRISING A FITMENT

FIELD OF THE INVENTION

This invention generally relates to the field of flexible containers. More particularly, the invention relates to optionally refillable containers fabricated from flexible film and comprising a fitment, wherein the fitment is connected to the container at a sealed junction formed by the film comprising the container, such as at a neck of the container.

BACKGROUND OF THE INVENTION

Flexible "stand-up" pouches and bottles for holding liquids and other pourable products are very popular. Such products are advantageous as compared to traditional containers for pourable products because, among other reasons, flexible plastic pouches and bottles help reduce solid waste and are less costly to manufacture. An early stand-up pouch design dubbed the "Doyen pouch" is described in U.S. Pat. No. 3,380,646, and it is still in use today. A well-known version of traditional Doyen pouch, at least in the United States, is the Capri Sun® juice drink pouch. Subsequent modifications of the Doyen design included installation of fitments between the two panels at the top portion of the pouch to allow the pouch to be reclosed after opening.

A major difficulty with the installation of fitments in Doyen pouches, however, (and in other pouch designs as well) is that, according to early prior art fitment sealing methods, the fitment must be of the "canoe" style to create a joint that can be reliably sealed. Canoe style fitments are illustrated in, e.g., U.S. Pat. Nos. 4,415,085, 4,732,299, and 5,660,477. The canoe type of fitment was an attempt to minimize the change in direction of pouch material as it comes into contact with the fitment. Put another way, the canoe type of fitment is designed to minimize the angle of divergence of two portions of container material that separate and move apart to envelope (and subsequently be sealed to) the fitment. In so doing, canoe style fitments improved the integrity of the joint where the two sides of the pouch come together at the fitment. However, even the use of a canoe shaped fitment does not completely solve the difficulties in sealing a fitment into a pouch, and a more reliable sealing means is desirable.

This problem was addressed in U.S. Pat. Nos. 6,832,852 and 7,147,597, both of which are incorporated herein in their entirety by reference. As shown in the '852 and '597 patents, while canoe style fitments can be used in connection with the present invention, "cylindrical base" fitments are preferred. The sealing surface of a cylindrical base style fitment is preferably substantially parallel to the axis of the fitment, as in the canoe style, but it does not include external corners at sharply acute angles around its circumference, as do canoe style fitments. Rather, in accordance with a first style of cylindrical base fitment, the circumference is preferably comprised of smooth and preferably convex curves. Having the circumference comprised of smooth curves is intended to facilitate the sealing of web material to the base of the fitment with two overlapping sealing steps applied from different directions. These sealing steps include: (i) clamping bottle material to the fitment with a heated clamping means to create a seal between the bottle material and the fitment, and (ii) clamping the bottle material to the fitment with a heated clamp a second time, the second clamping being at a different radial angle. By this method, the fitment is installed (i.e., adhered to by heat and pressure) in a neck of the bottle by way of a leakproof seal formed by the clamps.

Suitable optionally refillable flexible containers for use in connection with the present invention may be formed, by way of non-limiting example, in accordance with the disclosures of the '852 and '597 patents, as well as U.S. Pat. Nos. 8,231,029, 8,348,509, and 8,840,305, all of which are incorporated herein in their entirety by reference.

Despite the technological advancements in the art provided by the '852 and '597 patents, there remains room for an improvement to the methods and devices described therein, particularly with respect to method of the sealing of the fitment to the bottle. For example, although the two-step multi-directional sealing process for attaching a substantially cylindrical fitment to the neck of a flexible bottle has proven to be substantially reliable, the strength and integrity of the seal at the respective surfaces of the fitment and the bottle neck are enhanced by way of the improvements described herein. This is particularly important with respect to containers constructed in accordance with the '852 and '597 patents, which may be used to contain larger volumes of flowable material than what is suitable for Doyen style pouches. For example, the containers of the '852, '597, '029, '509, and '305 patents can stand up on their own at volumes of 20 liters, whereas Doyen style pouches will typically fall over and/or are very unwieldy at such large volumes, particularly where the pouches have no carrying handles. These larger volumes, which are highly desirable in the flexible container market, put higher physical stresses on the fitment and the film structure, particularly at the junction of the fitment and the film neck of the container.

For example, because fitments are often sealed to varying layers of flexible material at different locations along the circumference of a fitment, it is a challenge to apply the proper temperature, pressure, time, and location of such seals on the fitment as would otherwise help to optimize the strength and reliability of the overall seal. Thicker layers of material will typically require a greater amount of heat and pressure to cause such layers to be reliably sealed to a fitment. However, the same amount of heat and pressure may compromise the integrity of thinner layers of material to be adhered to the fitment, which may become brittle. Therefore, there remains an unmet need in the art for flexible containers fabricated from flexible film and comprising a fitment, wherein an improved seal at the junction of the flexible film and the fitment is provided.

It has been found that larger volume flexible containers of the prior art, such as those having 20 liters of water inside, can withstand the physical stresses of being dropped vertically on their base from several feet. However, when dropped on their cap (i.e., at a top portion where the fitment is typically located and connected to the cap) from 6 inches, the prior art containers may burst open at the junction of the film and the fitment at the neck of the container. This integrity imbalance in drop performance between the ability of the container to sustain drops on its base as compared to drops on its cap needs to be addressed.

SUMMARY OF THE INVENTION

The present invention meets the aforementioned unmet need by providing improved methods and devices for sealing a fitment to a flexible container, particularly in a neck of the container. Features and advantages of the present invention will become apparent upon a reading of the attached specification, in combination with a study of the drawings.

While preferred embodiments of the present invention are shown and described, it is envisioned that those skilled in the art may devise various modifications of the present invention without departing from the spirit and scope of the invention.

A preferred embodiment of the present invention comprises:

A method for sealing a fitment to a flexible container comprising the steps of:

providing a flexible container formed of flexible film and having a plurality of panels, a neck configured to be connected to a fitment, and a multiseal, the multiseal comprising a top edge, a bottom edge, a plurality of sealing surfaces, and a plurality of flaps;

providing the fitment for sealing at the neck, the fitment comprising a base surface;

placing the fitment in the neck, wherein the multiseal is provided around the base surface such that the multiseal and the base surface are complementarily aligned;

providing a plurality of primary seals on the multiseal via engagement of the multiseal by a plurality of primary sealing jaws, wherein the primary sealing jaws form the primary seals at the sealing surfaces and flaps of the multiseal, wherein the sealing surfaces are sealed to the base surface and the flaps are folded toward and sealed to the sealing surfaces;

providing a plurality of secondary seals on the multiseal via engagement of the multiseal by a plurality of secondary sealing jaws, wherein the secondary sealing jaws form the secondary seals at the sealing surfaces and flaps of the multiseal, wherein the secondary seals overlap with the primary seals, and wherein the secondary seals are located substantially closer to the top edge of the multiseal than to the bottom edge of the multiseal; and providing a plurality of tertiary seals on the multiseal via engagement of the multiseal by a plurality of tertiary sealing jaws, wherein the tertiary sealing jaws form the tertiary seals at the sealing surfaces and flaps of the multiseal, wherein the tertiary seals overlap with the primary seals and the secondary seals.

The present invention, in some preferred embodiments, provides for a substantial improvement in drop performance when the container is dropped vertically on its cap (i.e., on the fitment portion). Testing has shown that a 10 liter container provided in accordance with a preferred embodiment of the present invention and filled with water can be dropped from one meter on its cap and not rupture, whereas containers of the prior art may rupture under the same testing parameters except that the drop distance is merely 14 centimeters. This is especially important when shipping hazardous liquids in containers formed in accordance with the present invention. For example, United Nations ("UN") testing of containers for hazardous liquids requires the container to be tested by being dropped on all sides including with the top and cap pointing downwardly and making first impact with a surface. 10 liter volume containers formed in accordance with the present invention passed UN #1760 Class 8 tests.

An advantage of the present invention is that it provides devices and methods that form a reliable and robust multiseal of flexible material at specific locations about the circumferential surface of a base of a fitment, thereby allowing greater heat and pressure to be applied as desired to multiple material layers adhered to the base of the fitment to form a leakproof seal at the multiseal, while concurrently preserving the enhanced integrity of other thinner sealed portions that require less heat and pressure to be effectively sealed to the fitment.

DETAILED DESCRIPTION OF THE INVENTIONS

With reference to the figures and elements referenced herein, improved methods and devices for sealing a fitment to a flexible container are provided. It should be appreciated that the embodiments described and shown herein are exemplary in nature only and that various additional embodiments are contemplated and within the scope of the present invention.

As discussed in detail below, preferred embodiments of the present invention comprise flexible containers, such as optionally refillable bottles formed of a flexible material, such as webs of plastic film. In forming such bottles comprising a fitment sealed into a neck or other portion of the bottle, there often exists a need to seal one or more layers of the flexible material to a surface of the fitment. The process of doing so, as well as the corresponding bottle structure, provide for a robust, reliable, and preferably leak-proof seal at the juncture of the fitment and the layers of bottle material. Such seals are often critical to the endurance and utility of the containers that comprise them. This is because a rupture, such as in seals of the prior art, may result in catastrophic failure of the corresponding prior art bottle, such that bottle contents may leak or flow out of the bottle body at the ruptured seal between the fitment and bottle material, as opposed to through the installed fitment as intended. The present disclosure teaches novel and inventive improvements to such seals as applicable to a variety of flexible bottles that are suitable for use with preferred embodiments of the present invention.

Figure 1:
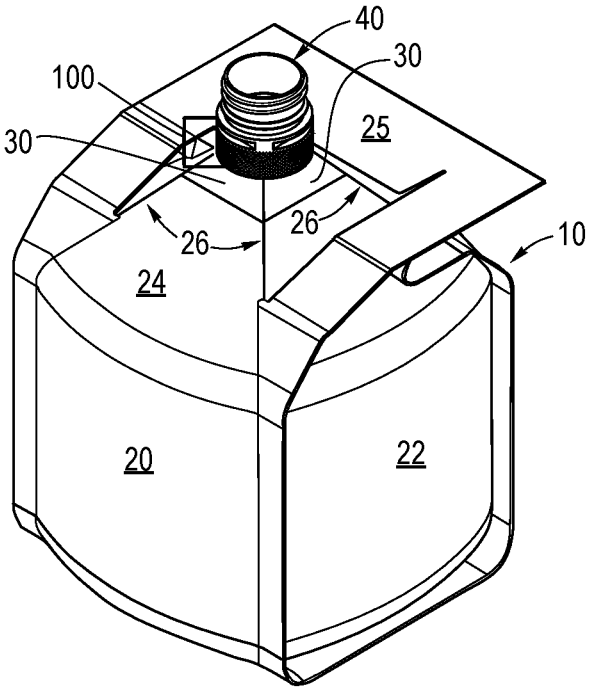
FIG. 1 is a perspective view illustration of a flexible container comprising a fitment provided in accordance with a preferred embodiment of the present invention.

FIG. 1 is a perspective view illustration of a finished flexible container 10 comprising a fitment 40 sealed therein and provided in accordance with a preferred embodiment of the present invention. As shown, the container 10 preferably comprises a multi-panel construction. In a preferred embodiment, container 10 comprises a front panel 20, back panel 21 (not shown), first side panel 22, second side panel 23 (not shown), as well as top segment 24, handle 25, container edges 26, optional cap 27 (not shown), neck 30, fitment 40, and multiseal 100. It will be appreciated by those of ordinary skill in the art that container 10 may comprise a different number of panels and/or additional features, such as a bottom handle. The container 10 may also omit handles altogether. In some preferred embodiments, panels 22, 23 are gusseted. Non-limiting examples of methods of fabricating the container 10 are disclosed in U.S. Pat. Nos. 6,832,852, 7,147,597, 8,231,029, 8,348,509, and 8,840,305, except that all methods disclosed therein should be deemed to exclude disclosure of steps comprising the improved sealing of fitment 40 to the neck 30, as provided in accordance with preferred embodiments of the present invention and as will be described below in further detail.

Container 10 is preferably formed by coextrusion of flexible film. For example, the film comprising container 10 is preferably a film formed of a coextrusion of high-density polyethylene ("HDPE") outer portion and a low-density polyethylene ("LDPE"), or linear low density polyethylene ("LLDPE") inner sealant portion. In this example, the outer HDPE portion of the film is preferably approximately 3 mils thick, and the LDPE or LLDPE inner sealant portion of the film is preferably approximately 7 mils thick. Therefore, in preferred embodiments of the present invention, the film comprising container 10 is preferably approximately 10 mils thick. The film comprising container 10 may be formed of a single coextruded film comprising HDPE and LDPE or LLDPE portions, or one or more layers of coextruded film coupled with one or more layers of film that may or may not be coextruded. For example, in an alternative embodiment, the container 10 comprises two separate layers of film, wherein an outer layer is a coextrusion of HDPE and LDPE film that is preferably approximately 10 mils thick (consistent with the above description of such a layer) and an inner layer of LDPE that is preferably approximately 4 mils thick.

In an embodiment, container 10 is formed from a coextruded multilayer film wherein each layer is composed of polyethylene. A coextruded multilayer film wherein each layer is composed of a polyethylene is interchangeably referred to as an "all-polyethylene" film.

In an embodiment, container 10 is formed from an all-polyethylene film that is a five layer film. The five layer film has the following layer structure: HDPE(skin)/LLDPE/LLDPE/LLDPE/polyolefin plastomer (seal).

Figure 2:
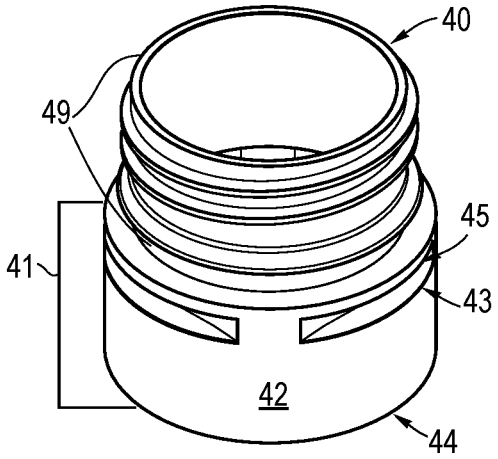
FIG. 2 is a perspective view illustration of a fitment provided in accordance with a preferred embodiment of the present invention.

FIG. 2 is a perspective view illustration of a fitment 40 provided in accordance with a preferred embodiment of the present invention. As shown, fitment 40 comprises a base 41, a base surface 42, a top base edge 43 (at the lower edge of registration portion 45), a bottom base edge 44, a registration portion 45, and a threaded portion 49. In preferred embodiments of the present invention, the fitment 40 is preferably cylindrical, although fitments of other shapes may be used. Moreover, as a consequence of the preferably cylindrical shape of the fitment 40, the base 41 is also preferably cylindrical and round in cross-section, having a circumference and a diameter. The base surface 42 is preferably smooth, although it is contemplated that the surface 42 may be ribbed or undulated. The fitment 40 is preferably comprised of HDPE, but other material combinations of film and fitment 40 may also be used, such as polypropylene film and fitment.

Figure 3:
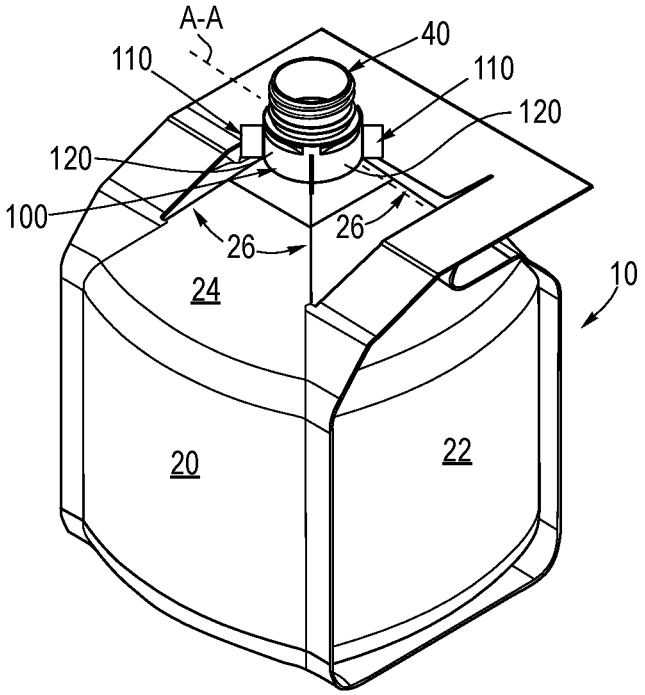
FIG. 3 is a perspective view illustration of a fitment prepared for sealing to a neck of a flexible container (i.e., prior to sealing) as provided in accordance with a preferred embodiment of the present invention.

FIG. 3 is a perspective view illustration of the fitment 40 prepared for sealing to a neck 30 of the flexible container 10 (i.e., prior to sealing) as provided in accordance with a preferred embodiment of the present invention. As shown, the panels 20, 21, 22, 23 preferably extend toward the neck 30 to form the top segment 24. The panels 20, 21, 22, 23 are sealed together at container edges 26, such that the multiseal 100 is formed at the neck 30.

As further shown in FIG. 3, and as will be described further below, the multiseal 100 preferably comprises flaps 110, and sealing portions 120. In a preferred embodiment of the present invention, the flaps 110 are formed by the confluence and sealing together of two of the panels 20, 21, 22, 23, whereas the sealing portions 120 are formed by the material of a single panel 20, 21, 22, 23. For example, one of the flaps 110 is formed by the sealing together of the front panel 20 and first side panel 22 at a container edge 26, whereas an adjacent flap 110 is formed by the sealing together of the front panel 20 and the second side panel 23 at adjacent container edge 26. Therefore, the flaps 110 are preferably comprised of two layers of film. Meanwhile, the sealing portions 120 spanning between the flaps 110, as shown in FIG. 3, preferably comprising a single layer of film. For example, in the above described example, the sealing portion 120 spanning between the flaps 110 is comprised of the single layer of film forming the front panel 20. Such will be discussed in further detail below.

Other devices and methods for forming the flexible container 10 prepared for the installation of the fitment 40 as provided in accordance with the present invention may be suitable for use with the present invention, as will be appreciated by those of ordinary skill in the art. In most, if not all such devices and methods, there will preferably exist a step whereby material comprising the flexible container 10 will be made adjacent to the body of the fitment 40, such as at the neck 30 of the container 10 where the fitment 40 is be installed, and one or more layers of the material will be sealed, often by heat and pressure, to the fitment base 41 to form a robust and reliable seal intended to unite the fitment 40 and the container 10.

Figure 4:
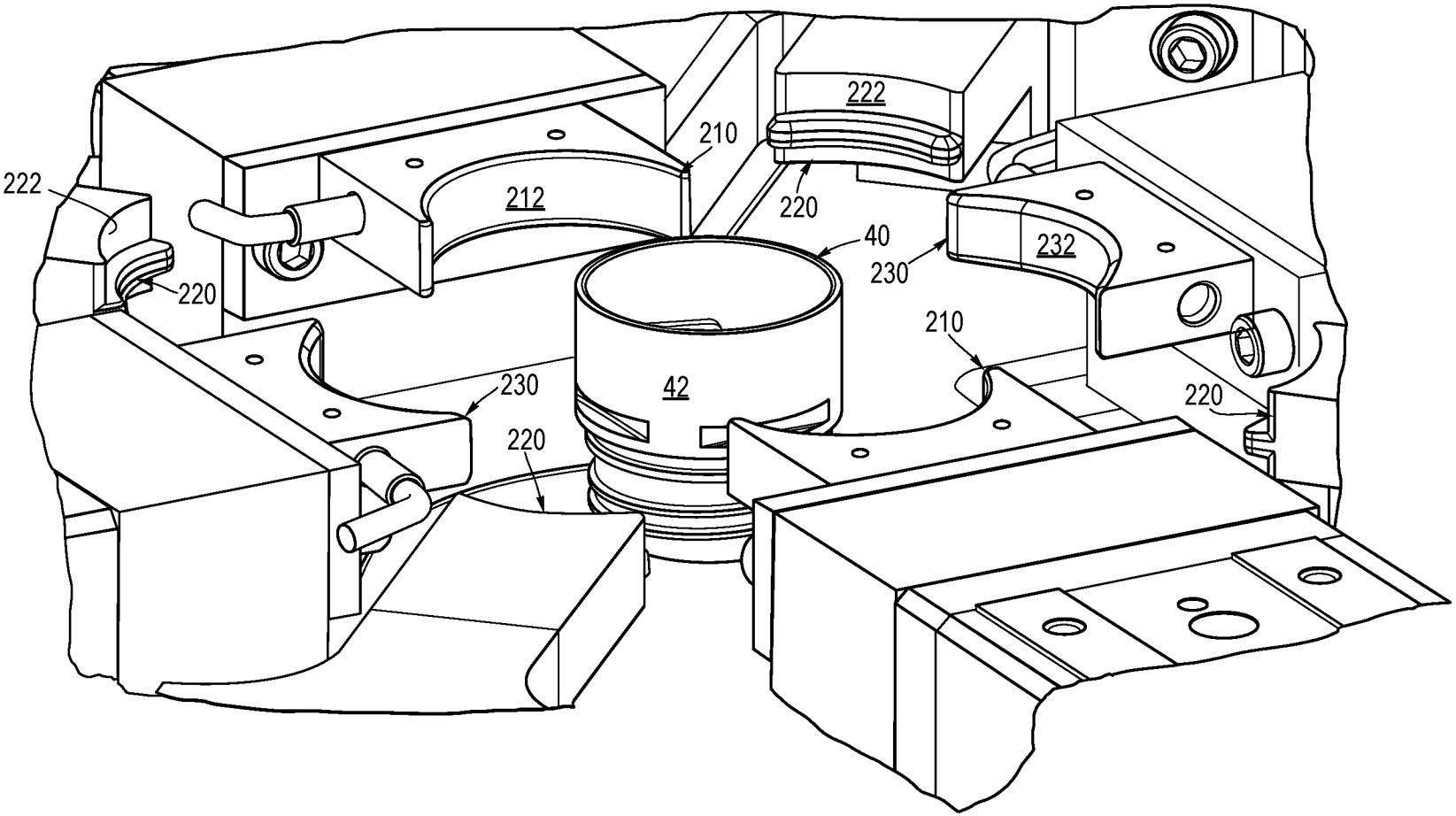
FIG. 4 is a perspective view illustration of a fitment as installed in a sealing machine (a corresponding flexible container body being omitted for clarity) as provided in accordance with a preferred embodiment of the present invention.

For example, FIG. 4 is a perspective view illustration of the fitment 40 as installed in a sealing machine 200 (a corresponding flexible container body being omitted for clarity) as provided in accordance with a preferred embodiment of the present invention. As shown, the sealing machine 200 comprises a plurality of sealing jaws, including first sealing jaws 210, second sealing jaws 220, and third sealing jaws 230. The sealing jaws 210, 220, 230 are used to seal the multiseal 100 to the fitment 40, thereby installing the fitment 40 in the container 10. As will be appreciated by those of ordinary skill in the art, the sealing jaws 210, 220, 230 are adjustable relative to each other and the fitment 40, such that the sealing jaws 210, 220, 230 may be made to engage the base 41 at different portions (i.e., heights and widths along the circumference) of the base surface 42. The sealing jaws 210, 220, 230 preferably comprise first sealing faces 212, second sealing faces 222, and third sealing faces 232, respectively, that are preferably complementary to the shape of the base 41, such that an indirect engagement of the sealing faces 212, 222, and 232 against the base surface 42 may be achieved, thereby forming a robust seal of the multiseal 100 to the base surface 42. The sealing machine 200 further comprises a heating means and a pressure means, such that the sealing jaws 210, 220, 230 seal the multiseal 100 to the base surface 42 by engaging the fitment 40 and applying heat and pressure.

Figure 5:
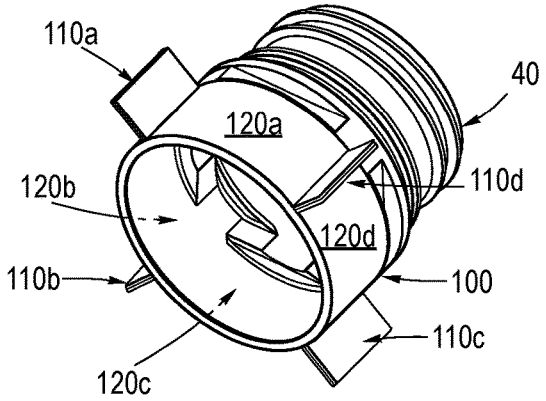
FIG. 5 is a perspective view illustration of a fitment prepared for sealing to a neck of a flexible container (i.e., prior to sealing, flaps up) via a multiseal, the illustration being shown in cross-section at axis A-A of FIG. 3 (the remainder of the corresponding flexible container being omitted for clarity), as provided in accordance with a preferred embodiment of the present invention.

FIG. 5 is a perspective view illustration of the fitment 40 prepared for sealing to the neck 30 via the multiseal 100 of the flexible container 10 (i.e., flaps 110 "up," prior to sealing), the illustration being shown in cross-section at axis A-A of FIG. 3 (the remainder of the corresponding flexible container being omitted for clarity), as provided in accordance with a preferred embodiment of the present invention. As will be described herein is a method for an incremental (i.e., stepwise) sealing of the multiseal 100 to the base surface 42 of the fitment 40. The method is referred to as the Multiseal Process. To be sure, the multiseal 100, as described above, is integrally formed from the confluence and sealing together of the panels 20, 21, 22, 23 at the neck 30 to form the flaps 110 and sealing portions 120. Additionally, as shown in FIG. 5 and for the sake of clarity in defining the Multiseal Process, multiseal 100 preferably comprises flaps 110*a,b,c,d* and sealing portions 120*a,b,c,d*. In this example of a preferred embodiment of the present invention, sealing portions 120*a,c* comprise the single film layer portions of the front and back panels 20, 21 respectively, whereas sealing portions 120*b,d* comprise the single film layer portions of the first and second side panels 22, 23, respectively. Therefore, the sealing portions 120*a,b,c,d* are preferably approximately 10 mils thick. Flap 110*a* comprises the film of front panel 20 and second side panel 23 sealed together at container edges 26 in the neck 30, as described above. Flap 110*b* comprises the film of second side panel 23 and back panel 21 sealed together at container edges 26. Flap 110*c* comprises the film of back panel 21 and first side panel 22 sealed together at container edges 26. Flap 110*d* comprises the film of first side panel 22 and front panel 20 sealed together at container edges 26.

A. Multiseal Process Step 1

In Multiseal Process Step 1, sealing jaws 210 enclose the fitment 40 to form primary seals 130, 131.

Figure 6:
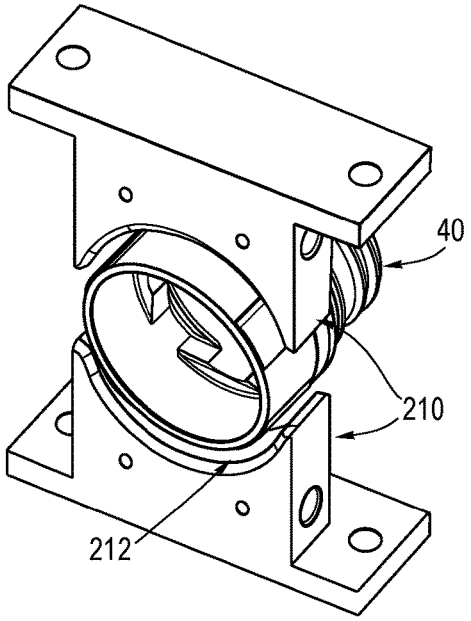
FIG. 6 is a perspective view illustration of the fitment and the multiseal of FIG. 5 engaged with first sealing jaws pursuant to a Multiseal Process Step 1 to form primary seals (see FIG. 7A) as provided in accordance with a preferred embodiment of the present invention.

FIG. 6 is a perspective view illustration of the fitment 40 and multiseal 100 of FIG. 5 engaged with first sealing jaws 210 pursuant to Multiseal Process Step 1 to form first and second primary seals 130, 131 (see FIG. 7A) of the multiseal 100 as provided in accordance with a preferred embodiment of the present invention. In this example, as shown in the Figures, particularly in FIG. 12, the base surface 42 has a height of preferably approximately 0.625 from a top base edge 43 to bottom base edge 44. As shown, the two first sealing jaws 210 of the sealing machine 200 engage the unfinished multiseal 100 at opposite sides of the fitment base surface 42. In this Step 1, sealing faces 212 are preferably complementary in shape to the fitment base surface 42, and the sealing jaws 210 apply heat and pressure at the sealing faces 212 to the multiseal 100 to seal it to the fitment base surface 42. The heat applied by the sealing jaws 210 is preferably approximately 300 degrees Fahrenheit, at a pressure of preferably approximately 100 pounds per square inch ("psi"), and a dwell of preferably approximately 3 seconds. The sealing jaws 210 engage the fitment 40 preferably simultaneously from opposing sides so the pressure applied to the fitment 40 is evenly distributed.

As will be appreciated by those of ordinary skill in the art, such sealing parameters listed herein correspond to the constituent materials and methods described herein with respect to the preferred embodiment of container 10. Accordingly, such parameters in the various steps of the Multiseal Process may be amended to accommodate the sealing of alternative embodiments of the present invention, such as embodiments comprising different thicknesses and material compositions of the film, as well as different container sizes and corresponding fitments.

Figure 7A:
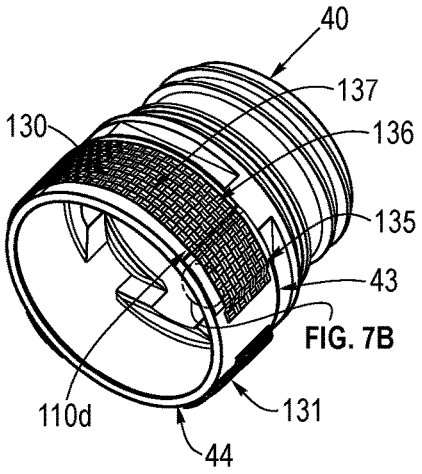
FIG. 7A is a perspective view of the fitment and the primary seals formed in FIG. 6 as provided in accordance with a preferred embodiment of the present invention.

As further shown in FIG. 6, when the first sealing jaws 210 engage the sealing portions 120*a,c*, the flaps 110*a,b* are pushed down toward, overlap with, and are made adjacent to the sealing portion 120*b* by the first sealing jaws 210, and the flaps 110*c,d* are pushed down toward, overlap with, and are made adjacent to the sealing portion 120*d* by the first sealing jaws 210, such that first and second primary seals 130, 131 are formed in the multiseal 100, as further shown in FIG. 7A.

Consequently, as best shown in FIG. 7A, first primary seal portions 135 of the first and second primary seals 130, 131 adhere the single layer of film (i.e., 10 mils thick) of the sealing portions 120*b,d*, respectively, to the base surface 42. Second primary seal portions 136 of the first and second primary seals 130, 131 adhere an overlapping portion comprising the two layers of film of the flaps 110 (i.e., 20 mils thick) and the single layer of film of the sealing portions

120*b,d*, respectively, to the base surface 42, thereby forming second primary seal portions 136 of the multiseal 100 that comprise film layers approximately 30 mils thick that have been partially sealed to the fitment 40. Third primary seal portions 137 of the first and second primary seals 130, 131 adhere the single layer of film (i.e., 10 mils thick) of the sealing portions 120*a,c*, respectively, to the base surface 42. As shown, the primary seals 130, 131 primarily affect the sealing portions 120*b, d* and the sealing portions comprising the flaps 110.

Figure 7C:
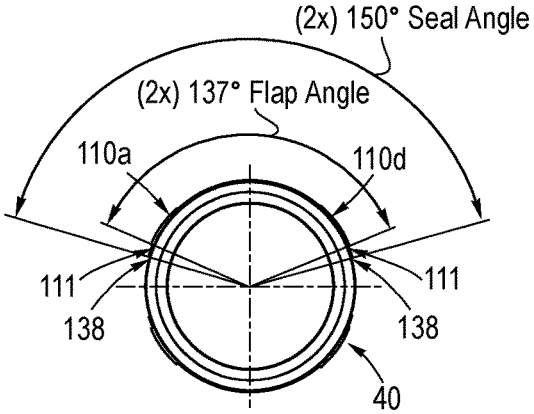
FIG. 7C is a radial view of the fitment showing the arc distance and location of the primary seals, as provided in accordance with a preferred embodiment of the present invention.
Figure 7B:
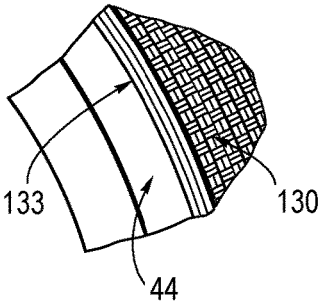
FIG. 7B is a zoomed in perspective view of the fitment and the primary seals of FIG. 7A, showing a gap between the primary seals and a bottom edge of the fitment, as provided in accordance with a preferred embodiment of the present invention.

As shown in FIGS. 7A-C, the primary seals 130, 131 as formed adhere by welding the sealing portions 120*a,c* to the base surface 42. Moreover, the primary seals 130, 131 partially adhere by welding flaps 110 to sealing portions 120*b,d*, which are correspondingly partially adhered by welding to the base surface 42. By "partially adhered," it is meant that although the primary seals 130, 131 are formed, such seals 130, 131 will be made more robust and reliable by way of additional steps of the Multiseal Process provided in accordance with the present invention.

As shown in FIG. 7B, there is preferably a gap between bottom edges 133 of the primary seals 130, 131 and the bottom base edge 44 that is preferably approximately 0.110 inches wide, and preferably approximately 0.100 inches from top base edge 43 to fitment. The primary seals 130, 131 in this example of a preferred embodiment are preferably approximately 0.44 inches wide. As best shown in FIG. 7C, the arc length between outer edges 111 of flaps 110*a,d* is preferably approximately 137 degrees, as is the arc length between outer edges 111 of flaps 110*b,c*. The arc length between the respective outer edges 138 of the first primary seal 130 is preferably approximately 150 degrees, as is the arc length between the respective outer edges 138 of the second primary seal 131. These lengths are complementary to the lengths of the sealing faces 221. Moreover, the arc length between the respective outer edges 138 first and second primary seals 130, 131 (i.e., where there exists no seal as of yet) is preferably approximately 30 degrees at each side. Although FIG. 7C depicts seal 130 only, it should be understood that seal 131 occurs in a complementary position on the opposite side of the fitment base surface 42.

B. Multiseal Process Step 2

In Multiseal Process Step 2, sealing jaws 220 enclose the fitment 40 to form secondary seals 140, 141, 142, 143, which overlap with the primary seals 130, 131.

Figure 8:
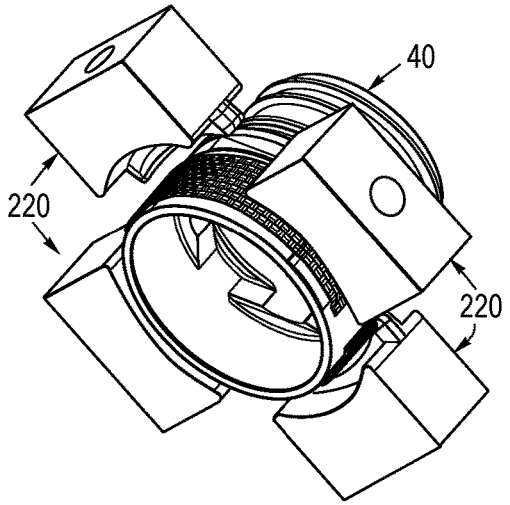
FIG. 8 is a perspective view illustration of the fitment and the primary seals of FIG. 7A engaged with second sealing jaws pursuant to Multiseal Process Step 2 to form secondary seals (see FIG. 9A) as provided in accordance with a preferred embodiment of the present invention.

FIG. 8 is a perspective view illustration of the fitment 40 and multiseal 100 of FIG. 7A engaged with second sealing jaws 220 pursuant to multiseal process step 2 to form first, second, third, and fourth secondary seals 140, 141, 142, 143 (see FIG. 9A) of the multiseal 100 as provided in accordance with a preferred embodiment of the present invention. As shown, the four second sealing jaws 220 of the sealing machine 200 engage the partially finished multiseal 100 at opposite sides of the fitment base surface 42. In this Step 2, sealing faces 222 are preferably complementary in shape to the fitment base surface 42, and the sealing jaws 220 apply heat and pressure at the sealing faces 222 to the multiseal 100 to further seal it to the fitment base surface 42. The heat applied by the sealing jaws 220 is preferably approximately 400 degrees Fahrenheit, at a pressure of preferably approximately 300 psi, and a dwell of preferably approximately 3 seconds. The second sealing jaws 220 engage the fitment 40 preferably simultaneously from opposition sides so the pressure applied to the fitment 40 is evenly distributed.

As shown in FIG. 8, the second sealing jaws 220 substantially overlap the primary seals 130, 131, including in particular at the flaps 100. However, by comparison to the primary seals 130, 131, the secondary seals 140, 141, 142, 143 formed by the second sealing jaws 220 are substantially thinner, having a width that is preferably approximately 0.125 inches wide. Moreover, the secondary seals 140, 141, 142, 143 are preferably located in close proximity to top base edge 43, the gap between the seals 140, 141, 142, 143 and edge 43 being preferably approximately 0.10 inches.

Figure 9A:
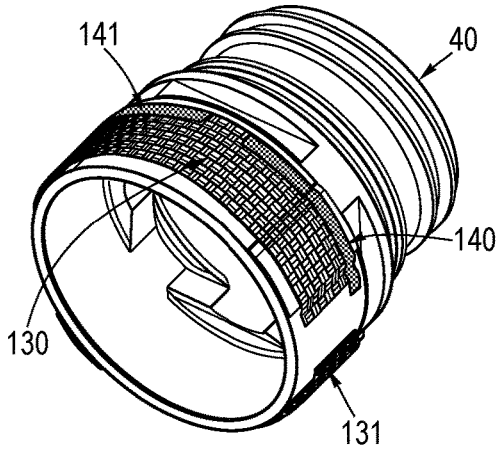
FIG. 9A is a perspective view of the fitment and the primary and secondary seals formed in FIG. 8 as provided in accordance with a preferred embodiment of the present invention.

Consequently, as best shown in FIG. 9A, first secondary seal portions 145 of the secondary seals 140, 141, 142, 143 overlap with the first primary seal portions 135 and further adhere the single layer of film (i.e., 10 mils thick) of the sealing portions 120*b,d*, respectively, to the base surface 42. Second secondary seal portions 146 of the secondary seals 140, 141, 142, 143 further adhere the overlapping portion comprising the two layers of film of the flaps 110 (i.e., 20 mils thick) and the single layer of film of the sealing portions 120*b,d*, respectively, to the base surface 42, thereby forming second secondary seal portions 146 of the multiseal 100 that reinforce the second primary seal portions 136, which is particularly important in view of the thickness of the film in those portions of the multiseal 100 at the flaps 110. Additionally, third secondary seal portions 147 of the secondary seals 140, 141, 142, 143 overlap with the third primary seal portions 137 and further adhere the single layer of film (i.e., 10 mils thick) of the sealing portions 120*a,c*, respectively, to the base surface 42. As shown, the secondary seals 140, 141, 142, 143 primarily affect the sealing portions 120 comprising the flaps 110.

Figure 9B:
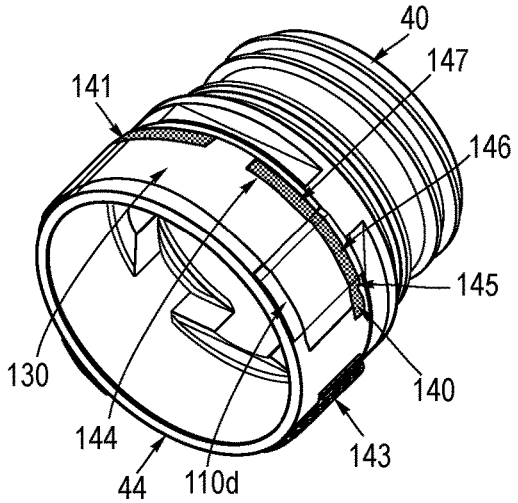
FIG. 9B is a perspective view of the fitment and the primary and secondary seals of FIG. 9A, showing the location of the secondary seals on the fitment and relative to the primary seals, as provided in accordance with a preferred embodiment of the present invention.
Figure 9C:
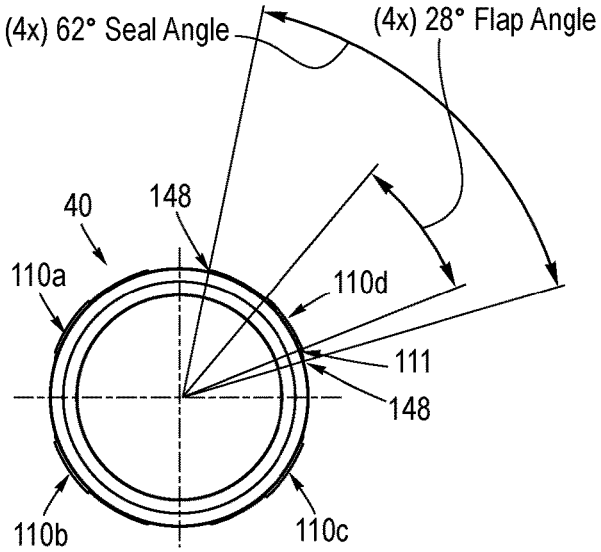
FIG. 9C is a radial view of the fitment showing the arc distance and location of the secondary seals, as provided in accordance with a preferred embodiment of the present invention.

As shown in FIGS. 9A-C, the secondary seals 140, 141, 142, 143 as formed further adhere by welding the sealing portions 120*a,c* to the base surface 42. Moreover, the secondary seals 140, 141, 142, 143 further adhere by welding flaps 110 to sealing portions 120*b,d*, which are correspondingly partially adhered by welding to the base surface 42. In this manner the multiseal 100 is made more robust and reliable by way of additional steps of the Multiseal Process provided in accordance with the present invention.

As best shown in FIG. 9B, there is preferably a gap between bottom edges 144 of the secondary seals 140, 141, 142, 143 and the bottom base edge 44 that is preferably approximately 0.44 inches, and preferably approximately 0.100 inches from top base edge 43 to top edges 149. The secondary seals 140, 141, 142, 143 in this example of a preferred embodiment are preferably approximately 0.125 inches wide. As best shown in FIG. 9C, the arc length between the edges of a single flap 110 is preferably approximately 28 degrees. The arc length between the respective outer edges 148 of the first secondary seal 140 is preferably approximately 62 degrees, as is the arc length between the respective outer edges 148 of the other secondary seals 141, 142, 143. These lengths are complementary to the lengths of the sealing faces 222. Although FIG. 9C depicts seal 140 only, it should be understood that seals 141, 142, and 143 occur in complementary positions (i.e., at the flaps 110) of the fitment base surface 42. As shown in FIGS. 8-9C, in order for the seal jaws 220 to have complementary angles of attack and thus be evenly space around the fitment 40, it has been found that the flaps 110 are not centered on the sealing faces 222, but instead are offset from the center of the sealing faces 222 by approximately 25% of the arc length of the sealing faces 222.

As previously discussed, a particular benefit of the reduced size and particular location of the secondary seals 140, 141, 142, 143 is that additional heat may be applied to reinforce the sealing of the flaps 110 to the fitment 40 where the thickness of the film is greater. It is also advantageous to apply the secondary seals 140, 141, 142, 143 nearer to the top base edge 43 so as to mitigate the possibility that single layer portions of the multiseal 100 may be made brittle or unreliable in view of the enhanced heat toward the bottom base edge 44, where the pressure among the junction of the neck 30 and the fitment 40 is often the greatest and where most ruptures tend to occur in prior art containers.

C. Multiseal Process Step 3

In Multiseal Process Step 3, sealing jaws 230 enclose the fitment 40 to form tertiary seals 150, 151, which overlap with the primary seals 130, 131 and secondary seals 140, 141, 142, 143.

Figure 10:
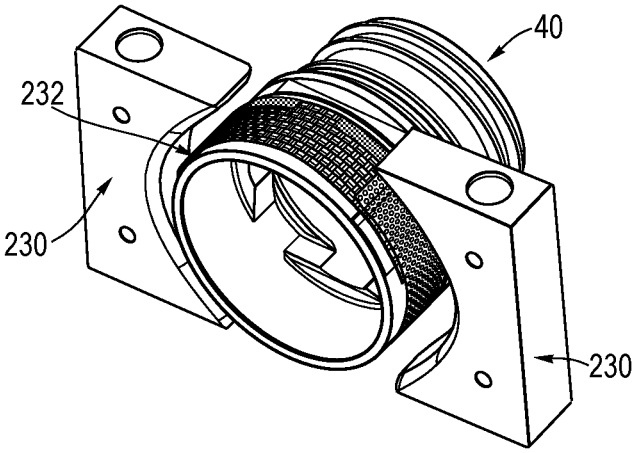
FIG. 10 is a perspective view illustration of the fitment and primary and secondary seals of FIG. 9A engaged with third sealing jaws pursuant to Multiseal Process Step 3 to form tertiary seals (see FIG. 11A) as provided in accordance with a preferred embodiment of the present invention.

FIG. 10 is a perspective view illustration of the fitment 40 and multiseal 100 of FIG. 9A engaged with second sealing jaws 230 pursuant to multiseal process step 3 to form first and second tertiary seals 150, 151 (see FIG. 11A) of the multiseal 100 as provided in accordance with a preferred embodiment of the present invention. As shown, the two tertiary sealing jaws 230 of the sealing machine 200 engage the partially finished multiseal 100 at opposite sides of the fitment base surface 42. In this Step 3, sealing faces 232 are preferably complementary in shape to the fitment base surface 42, and the sealing jaws 230 apply heat and pressure at the sealing faces 232 to the multiseal 100 to further seal it to the fitment base surface 42. The heat applied by the sealing jaws 230 is preferably approximately 300 degrees Fahrenheit, at a pressure of preferably approximately 150 psi, and a dwell of preferably approximately 3 seconds. The tertiary sealing jaws 230 engage the fitment 40 preferably simultaneously from opposition sides so the pressure applied to the fitment 40 is evenly distributed.

Figure 11A:
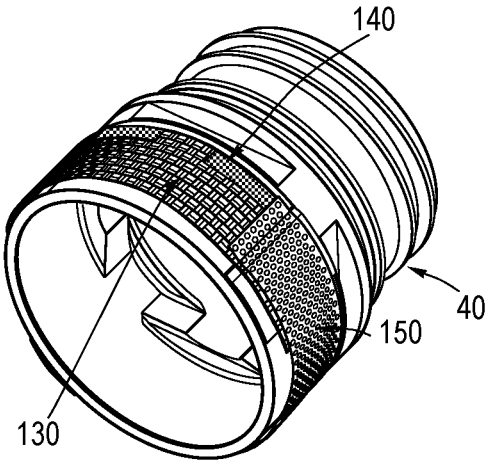
FIG. 11A is a perspective view of the fitment and the first, second, and tertiary seals formed in FIG. 10 as provided in accordance with a preferred embodiment of the present invention.

As shown in FIG. 10, the tertiary sealing jaws 230 substantially overlap the primary seals 130, 131, and secondary seals 140, 141, 142, 143. Consequently, as best shown in FIG. 11A, first tertiary seal portions 155 of the tertiary seals 150, 151 overlap with the first primary seal portions 135 and the first secondary seal portions 145 to further adhere the single layer of film (i.e., 10 mils thick) of the sealing portions 120*b,d*, respectively, to the base surface 42. As shown, tertiary seals 150, 151 also serve to seal the portions of sealing portions 120*b,d* that were previously unsealed to the base surface 42. Second tertiary seal portions 156 of the tertiary seals 150, 151 further adhere the overlapping portion comprising the two layers of film of the flaps 110 (i.e., 20 mils thick) and the single layer of film of the sealing portions 120*b,d*, respectively, to the base surface 42, thereby forming second tertiary seal portions 156 of the multiseal 100 that reinforce the second primary seal portions 136 and the second secondary seal portions 146, which is particularly important in view of the thickness of the film in those portions of the multiseal 100 at the flaps 110. Additionally, third tertiary seal portions 157 of the tertiary seals 150, 151 overlap with the third primary seal portions 137 and the third secondary seal portions 147 to further adhere the single layer of film (i.e., 10 mils thick) of the sealing portions 120*a,c* respectively, to the base surface 42.

Figure 11B:
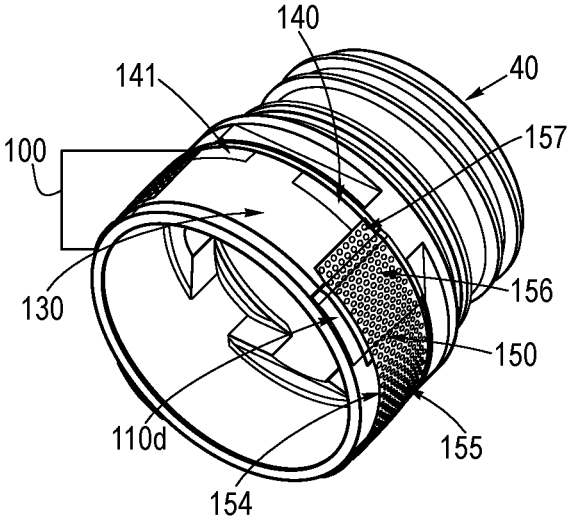
FIG. 11B is a perspective view of the fitment and the primary and secondary seals of FIG. 11A, the location of the tertiary seals on the fitment and relative to the primary and secondary seals, as provided in accordance with a preferred embodiment of the present invention.
Figure 11C:
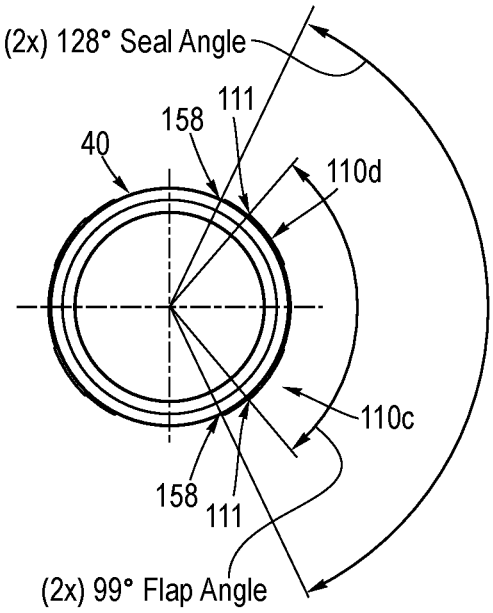
FIG. 11C is a radial view of the fitment showing the arc distance and location of the tertiary seals, as provided in accordance with a preferred embodiment of the present invention.

As shown in FIGS. 11A-C, the tertiary seals 150, 151 as formed further adhere by welding the sealing portions 120*b,d* to the base surface 42. Moreover, the tertiary seals 150, 151 further adhere by welding flaps 110 to sealing portions 120*b,d*, which are correspondingly partially adhered by welding to the base surface 42. In this manner the multiseal 100 is made more robust and reliable by way of additional steps of the Multiseal Process provided in accordance with the present invention.

As best shown in FIG. 11B, there is preferably a gap between bottom edges 154 of the tertiary seals 150, 151 and the bottom base edge 44 that is preferably approximately 0.185 inches, and preferably approximately 0.10 inches from top base edge 43 to top edges 159. The tertiary seals 150, 151 in this example of a preferred embodiment are preferably approximately 0.31 inches wide. As best shown in FIG. 11C, the arc length between the respective outer edges 158 of the first tertiary seal 150 is preferably approximately 128 degrees, as is the arc length between the respective outer edges 158 of the second tertiary seal 151. Although FIG. 11C depicts seal 150 only, it should be understood that seal 151 occurs in a complementary position on the opposite side of the fitment base surface 42.

Figure 12:
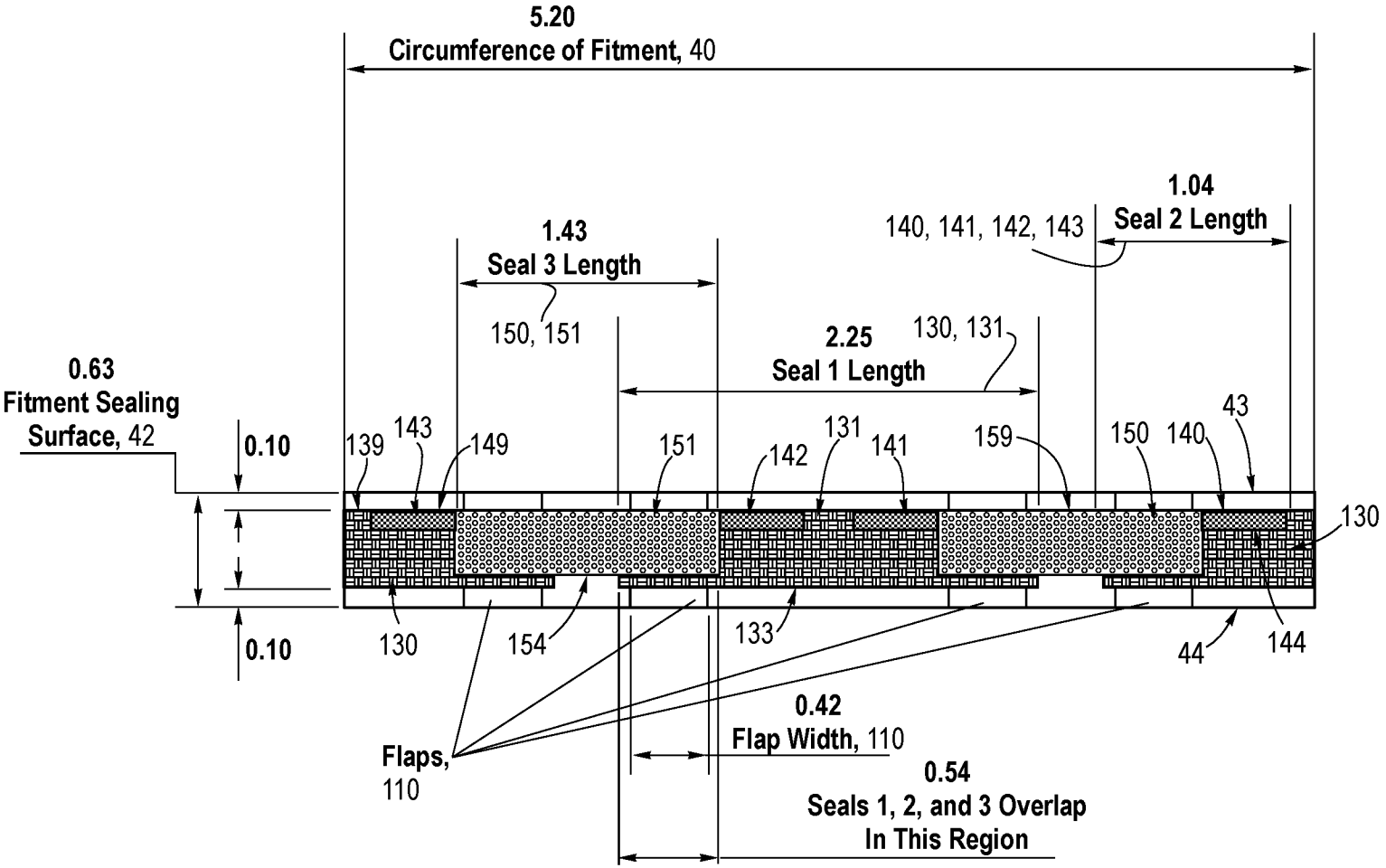
FIG. 12 is flattened depiction of a fitment base surface and corresponding multiseal, as provided in accordance with a preferred embodiment of the present invention.

FIG. 12 illustrates for clarity a flattened depiction of a fitment base surface 42 and a corresponding multiseal 100. As shown, in one example of a preferred embodiment of the present invention, the fitment base surface 42 has a circumference of preferably approximately 5.2 inches and height of preferably approximately 0.625 inches. As shown, the preferably two seals 130, four seals 140, and two seals 150 are spaced apart and overlap as shown and also described above. Notably, the portions of the multiseal 100 where one each of seals 130, 140, and 150 overlap is at the flaps 110. The flaps 110 in this example have a width of preferably approximately 0.42 inches and the width of the overlap portion of one each of seals 130, 140, and 150 is preferably approximately 0.54 inches and directly overlapping flap 110. In this way, by providing the multiseal 100 having Multiseal Process Steps 1-3 (and sometimes 1-4 as described below), the integrity and drop performance of the container 10 at the juncture of the fitment 40 and the film of the neck 30 is dramatically improved because the flaps 110 have been made leak-proof at the fitment base surface 42 by, in particular the thinner, higher pressure, and higher temperature seal 140 near the top edge 43. Moreover, other portions of the multiseal 100, such as at third primary seal portions 137 and first tertiary seal portions 155 that seal single layer sealing portions 120 to the fitment base surface 42 are likewise leak-proof but have not been made weak or brittle by excessive sealing.

It is contemplated that a greater or lesser number of jaws may be used. For example, jaws 220 may be a pair of complementary jaws 220 instead of four jaws 220, wherein a gap is machined between pairs of sealing faces 222 such that although jaws 220 are two instead of four, preferably four secondary seals 140, 141, 142, 143 are still imparted on the multiseal 100.

It is contemplated that extra steps of the Multiseal Process may be employed. For example, a Multiseal Process Step 4 comprising a repeat of Multiseal Process 1 for a one second dwell smooths out surface indents that may be imparted on the multiseal 100 by jaws 220 during the higher pressure and temperature Multiseal Process Step 2.

It is contemplated that the previously described multiseal process step 1, utilizing sealing jaws 210 (and hereafter "sealing step 1"), multiseal process step 2, utilizing sealing jaws 220 (and hereafter "sealing step 2"), and multiseal process step 3, utilizing sealing jaws 230 (and hereafter "sealing step 3") may be employed in different sequential orders. For example, the multiseal sealing sequence can be sealing step 1 followed by sealing step 2, followed by sealing step 3. Alternatively, the multiseal sealing sequence can be sealing step 1 followed by sealing step 3, followed by sealing step 2.

In an embodiment, container 10 is formed from a five layer all-polyethylene film and container 10 has one, some, or all of the following properties:

(i) passes the burst test at 18 mm Hg; and/or (ii) passes the top drop test; and/or (iii) exhibits a fitment-to-neck seal interface that is smooth and free of defects.

By way of example, and not limitation, examples of the present disclosure are provided.

EXAMPLES

Four panel flexible containers having a neck (with no fitment) and a body as shown in FIG. 1 and in FIG. 3 are formed using the five-layer film provided in Table 1 below. The five-layer film is an "all-polyethylene" multilayer film. Each of the four panels is made with the five-layer film shown in Table 1. The four-panel flexible containers have a volume of one gallon (3.875 L).

TABLE 1

All polyethylene film Structure- 8 mil/200 micron

| Film Layer | Film Composition | Film Thickness (% by weight) |
|---|---|---|
| A (Skin layer) | Dowlex 2038.68G (HDPE)<br>Density 0.935 g/cc<br>MI 1.0 g/10 min | 20% |
| B | Innate ST 50 (LLDPE)<br>Density 0.918 g/cc<br>MI 0.85 g/10 min | 20% |
| C | Innate ST 50 (LLDPE)<br>Density 0.918 g/cc<br>MI 0.85 g/10 min | 20% |
| D | Innate ST 50 (LLDPE)<br>Density 0.918 g/cc<br>MI 0.85 g/10 min | 20% |
| E (Seal layer) | 95% Affinity 1146G<br>+4% Antiblock<br>(20% silica + 80% LDPE)[+]<br>+1% Erucamide<br>(5% Slip + 95% LDPE) [#] | 20% |

[+]Antiblock = Silica Masterbatch (20% Diatomaceous Earth + 80% Dow LDPE 722))
[#] Erucamide Masterbatch (5% Slip + 95% Dow LDPE 722)

Density is measured in accordance with ASTM D 792.

Melt index (MI) is measured in accordance with ASTM D 1238, Condition 190° C./2.16 kg (g/10 minutes).

Four panels made from the flexible multilayer film in Table 1 are heat sealed together under the heat seal conditions provided in Table 2 (below) to produce flexible container blanks (i.e., a "blank" being a flexible container without a fitment). The four-sided flexible containers have the geometry and design of the flexible containers as shown in FIG. 1 and in FIG. 3, without a fitment. The flexible containers have a volume of one gallon (3.875 L).

A fitment with a base diameter of 41 mm is inserted into the neck for each respective flexible container. Each fitment is made from the same high density polyethylene (HDPE). A 38 mm diameter mandrel inserted into the base of the fitment. The mandrel includes an expandable collar. The expandable collar is made of Shore A 30+/−5 durometer FDA approved silicone rubber.

With the mandrel inserted in the base, and the collar expanded, the base of the fitment is heat sealed to the neck of the flexible container using sealing jaws 210, 220, 230 as shown in FIG. 4 and the mandrel collar expanded to support the base of the fitment as set forth in US Patent Application Publication No. 2018/0071991, filed on 5 Oct. 2017, the entire contents of which are incorporated by reference herein. The heat sealing parameters for sealing the fitment to the neck of the flexible container are set forth in Table 2 below.

TABLE 2

Sealing Configuration - Temperature and Sealing Times

| Sealing step | IE 1 Seal temp (C.) | IE 1 Seal time (sec) | CS1 Seal temp (C.) | CS1 Seal time (sec) |
|---|---|---|---|---|
| 1 Sealing jaws 210 form seals (FIG. 4) | 143 | 5 | 160 | 7 |
| 2 Sealing jaws 320 form seals(FIG. 4) | 149 | 8 | 163 | 9 |
| 3 Four diagonal sealing jaws 220 form seals (FIG. 4) | 177 | 3 | n/a | |
| Total times | | 16 | | 16 |

CS = comparative sample
IE = inventive example

The flexible container with fitment sealed thereto is evaluated for burst test, top drop test, and seal appearance. The procedure for the burst test and the procedure for the top drop test are provided below.

Burst Test Procedure

Process:

1.) All flexible containers are numbered/tagged with testing number, identifying film #, and production set points (if necessary).
2.) All flexible containers are pre-inflated via manual inflation or compressed air.
3.) Caps are applied tightly.
4.) Flexible containers are placed inside the vacuum pressure chamber and lid is closed.
5.) Vacuum pressure is applied via vacuum pump. Pressure should be applied slowly as flexible container continues to inflate.
6.) Units of vacuum are recorded in (inHg). Exceptional results are 18 (inHG) held for 60 seconds. Passing is 12 (inHg).
7.) Any weak areas of seal will be exposed as leaks during the testing time period. Bubbles should be looked for and can indicate a weak area of the flexible container.
8.) The flexible container is filled completely with air and the closure on the fitment is tightened. Then, the flexible container is completely submerged in a water bath. The chamber over the water is then evacuated to create a vacuum. A "pass" score for the burst test is when there are no bubbles visually observed in the water bath after 30 seconds at 40 kilopascals of vacuum.

Top Drop Test

Each flexible container is filled with 3800 grams of water was held by bottom handle with the cap directly aligned to the drop surface. The distance is measured from the cap to the drop surface. The drop surface is smooth concrete. Data was only collected from samples where the cap struck the drop surface first. Failure is defined as any leakage of the package after dropping.

The results for the burst test, the top drop test, and seal appearance are provided in Table 3 below.

TABLE 3

Flexible Package Performance

| Package type | Burst test Vacuum Seal 18 mm Hg | Top Drop Test (0.5 meters) s | Top drop (1.0 meters) | Seal Appearance |
|---|---|---|---|---|
| IE1 | 5/5 - Passed | 5/5 - Passed | 5/5 - Passed | Seal interface is smooth and |

TABLE 3-continued

| Flexible Package Performance | | | | |
|---|---|---|---|---|
| Package type | Burst test Vacuum Seal 18 mm Hg | Top Drop Test (0.5 meters) s | Top drop (1.0 meters) | Seal Appearance |
| CS1 | 5/5 - Passed | 0/5 - Passed | 0/5 - Passed | free from heat damage Heat damage to the film but at optimal seal conditions |

Applicant discovered that the present three step multiseal process utilizing sealing jaws 210, 220, and 230 unexpectedly enables a reduction in heat seal temperature during heat sealing, thereby enabling an all-polyethylene film to be used for the flexible container. The present multiseal process with sealing jasws 210, 220, 230 eliminates the need for a polyamide skin layer or a polyester skin layer, typically required to provide heat resistance during the heat sealing procedure. A flexible package made from an all-polyethylene multilayer film is advantageous for processability (multilayer film with all-polyethylene layers is co-extrudable and does not require a lamination step). Another benefit of an all-polyethylene film is its recyclability.

It is specifically intended that the present disclosure not be limited to the embodiments and illustrations contained herein, but include modified forms of those embodiments including portions of the embodiments and combinations of elements of different embodiments as come with the scope of the following claims.

The invention claimed is:

1. A method for sealing a fitment to a flexible container comprising the steps of:

providing a flexible container formed of flexible film and having a plurality of panels, and a neck configured to be connected to a fitment via a multiseal, the multiseal formed from the plurality of panels being sealed at the neck and comprising a top edge, a bottom edge, a plurality of sealing surfaces, and a plurality of flaps;

providing the fitment for sealing at the neck, the fitment comprising a base surface;

placing the fitment in the neck, wherein the multiseal is provided around the base surface such that the multiseal and the base surface are complementarily aligned;

providing a plurality of primary seals on the multiseal via engagement of the multiseal by a plurality of primary sealing jaws, wherein the primary sealing jaws form the primary seals at the sealing surfaces and flaps of the multiseal, wherein the sealing surfaces are sealed to the base surface and the flaps are folded toward and sealed to the sealing surfaces;

providing a plurality of secondary seals on the multiseal via engagement of the multiseal by a plurality of secondary sealing jaws, wherein the secondary sealing jaws form the secondary seals at the sealing surfaces and flaps of the multiseal, wherein the secondary seals overlap with the primary seals, and wherein the secondary seals are located closer to the top edge of the multiseal than to the bottom edge of the multiseal; and providing a plurality of tertiary seals on the multiseal via engagement of the multiseal by a plurality of tertiary sealing jaws, wherein the tertiary sealing jaws form the tertiary seals at the sealing surfaces and flaps of the multiseal, wherein the tertiary seals overlap with the primary seals and the secondary seals.

2. A flexible container comprised of:

a flexible container formed of flexible film and having a plurality of panels, and a neck configured to be connected to a fitment via a multiseal, the multiseal formed from the plurality of panels being sealed at the neck and comprising a top edge, a bottom edge, a plurality of sealing surfaces, and a plurality of flaps;

a fitment for sealing at the neck, the fitment comprising a base surface;

the fitment in the neck, wherein the multiseal is provided around the base surface such that the multiseal and the base surface are complementarily aligned;

a plurality of primary seals on the multiseal via engagement of the multiseal by a plurality of primary sealing jaws, wherein the primary sealing jaws form the primary seals at the sealing surfaces and flaps of the multiseal, wherein the sealing surfaces are sealed to the base surface and the flaps are folded toward and sealed to the sealing surfaces;

a plurality of secondary seals on the multiseal via engagement of the multiseal by a plurality of secondary sealing jaws, wherein the secondary sealing jaws form the secondary seals at the sealing surfaces and flaps of the multiseal, wherein the secondary seals overlap with the primary seals, and wherein the secondary seals are located closer to the top edge of the multiseal than to the bottom edge of the multiseal; and a plurality of tertiary seals on the multiseal via engagement of the multiseal by a plurality of tertiary sealing jaws, wherein the tertiary sealing jaws form the tertiary seals at the sealing surfaces and flaps of the multiseal, wherein the tertiary seals overlap with the primary seals and the secondary seals.

* * * * *